US012583079B2

(12) United States Patent
Ota et al.

(10) Patent No.: US 12,583,079 B2
(45) Date of Patent: Mar. 24, 2026

(54) WAFER POLISHING METHOD AND WAFER POLISHING DEVICE

(71) Applicant: SUMCO CORPORATION, Tokyo (JP)

(72) Inventors: Hiroki Ota, Saga (JP); Yuki Nakano, Saga (JP)

(73) Assignee: SUMCO CORPORATION, Tokyo (JP)

( * ) Notice: Subject to any disclaimer, the term of this patent is extended or adjusted under 35 U.S.C. 154(b) by 567 days.

(21) Appl. No.: 18/025,337

(22) PCT Filed: Jul. 1, 2021

(86) PCT No.: PCT/JP2021/024893
§ 371 (c)(1),
(2) Date: Mar. 8, 2023

(87) PCT Pub. No.: WO2022/054380
PCT Pub. Date: Mar. 17, 2022

(65) Prior Publication Data

US 2023/0330809 A1 Oct. 19, 2023

(30) Foreign Application Priority Data

Sep. 9, 2020 (JP) ..... 2020-151460

(51) Int. Cl.
*B24B 49/16* (2006.01)
*B24B 37/013* (2012.01)
*B24B 49/02* (2006.01)

(52) U.S. Cl.
CPC ..... *B24B 49/16* (2013.01); *B24B 37/013* (2013.01); *B24B 49/02* (2013.01)

(58) Field of Classification Search
CPC ..... B24B 49/16; B24B 49/02; B24B 37/013; B24B 37/32
(Continued)

(56) References Cited

U.S. PATENT DOCUMENTS

2005/0020185 A1 1/2005 Zuniga et al.
2011/0014851 A1 1/2011 Fukuda et al.
(Continued)

FOREIGN PATENT DOCUMENTS

JP 2001-60572 A 3/2001
JP 2006-263903 A 10/2006
(Continued)

OTHER PUBLICATIONS

International Preliminary Report on Patentability issued in International Bureau of Wipo Patent Application No. PCT/JP2021/024893, dated Mar. 7, 2023, along with an English translation thereof.
(Continued)

*Primary Examiner* — Monica S Carter
*Assistant Examiner* — Caleb Andrew Holizna
(74) *Attorney, Agent, or Firm* — GREENBLUM & BERNSTEIN, P.L.C.

(57) ABSTRACT

A wafer polishing method includes acquiring in-plane thickness distribution information regarding a wafer to be polished or a wafer subjected to the same processing treatment, determining a difference in pressure between a pressure Pc to be applied to the central part of the wafer by introducing a gas into the central region and a pressure Pe to be applied to the outer peripheral part of the wafer by introducing a gas into the outer peripheral region, determining any one pressure of Pc and Pe, and determining the other pressure, determining the pressure Pg to be applied, based on a set value Pr of a contact pressure to be applied to the lower surface of the second ring-shaped member due to contact with the polishing pad at the time of polishing, and bringing the lower surface of the wafer into contact with the polishing pad to conduct polishing.

15 Claims, 9 Drawing Sheets

(58) Field of Classification Search
USPC ..... 451/5
See application file for complete search history.

(56) References Cited

U.S. PATENT DOCUMENTS

| | | | | |
|---|---|---|---|---|
| 2011/0136414 | A1 | 6/2011 | Masumura et al. | |
| 2015/0266159 | A1 | 9/2015 | Shiokawa et al. | |
| 2017/0173756 | A1* | 6/2017 | Yamaki | B24B 37/20 |
| 2018/0264619 | A1 | 9/2018 | Yoshida | |
| 2019/0333775 | A1 | 10/2019 | Nishitani et al. | |
| 2019/0389029 | A1* | 12/2019 | Nakamura | H01L 21/3212 |

FOREIGN PATENT DOCUMENTS

| | | | |
|---|---|---|---|
| JP | 2009-200068 | A | 9/2009 |
| JP | 2015-193068 | A | 11/2015 |
| JP | 2017-064801 | A | 4/2017 |
| WO | 2010/023829 | A1 | 4/2010 |
| WO | 2017/090406 | A1 | 1/2017 |

OTHER PUBLICATIONS

International Search Report issued in International Bureau of WIPO Patent Application No. PCT/JP2021/024893, dated Aug. 17, 2021, along with an English translation thereof.
Office Action issued in TAIWAN Counterpart Patent Appl. No. 110131046, dated Sep. 27, 2022.

* cited by examiner

WAFER POLISHING METHOD AND WAFER POLISHING DEVICE

CROSS REFERENCE TO RELATED APPLICATIONS

The present application claims priority from Japanese Patent Application No. 2020-151460, filed on Sep. 9, 2020, the entire disclosure of which is particularly incorporated herein.

TECHNICAL FIELD

The present invention relates to a wafer polishing method and a wafer polishing device.

BACKGROUND ART

The devices for polishing the surface of a wafer includes a one side polishing device for polishing one side of a wafer, and a double side polishing device for polishing both sides of a wafer. With the one side polishing device, normally, with the surface to be polished of a wafer held on a polishing head pressed against a polishing pad bonded on a surface plate, the polishing head and the surface plate are respectively rotated, thereby bringing the surface to be polished of the wafer and the polishing pad into contact with each other. By supplying an abrasive to between the surface to be polished and the polishing pad thus brought into contact with each other, it is possible to polish the surface to be polished of the wafer (for example, see Japanese Patent Application Publication No. 2006-263903 (the entire description of which is herein referred to as reference)

SUMMARY OF INVENTION

With wafer polishing using a one side polishing device, as described in paragraph 0007 of Japanese Patent Application Publication No. 2006-263903, or the like, in order to perform polishing processing with stability, a retainer ring is provided to hold a wafer to be polished. However, in order to improve the stability of polishing processing in wafer polishing, only provision of a retainer ring is not sufficient, and proper setting of the polishing conditions can contribute to the improvement of the stability of polishing processing in wafer polishing. However, conventionally, there has been no choice but to repeat much trial and error in order to find such polishing conditions.

In accordance with one aspect of the present invention, it is an object to enable stable wafer polishing processing to be performed by readily setting proper polishing conditions.

One aspect of the present invention relates to, a wafer polishing method (which will also be hereinafter referred to simply as a "polishing method") of polishing a wafer with a polishing device, wherein the polishing device includes:

a polishing head having:

a head main body part, a first ring-shaped member located below the head main body part, and having an opening, a plate-shaped member closing the opening on the upper surface side of the first ring-shaped member, a membrane closing the opening on the lower surface side of the first ring-shaped member, and a second ring-shaped member located below the membrane, and holding a wafer to be polished; and a polishing pad with which the lower surface of the wafer to be polished and the lower surface of the second ring-shaped member come in contact at the time of polishing, a space part formed by closing the opening of the first ring-shaped member by the plate-shaped member and the membrane has a central region and an outer peripheral region partitioned from the central region, the wafer polishing method includes:

acquiring in-plane thickness distribution information regarding the wafer to be polished or a wafer subjected to the same processing treatment as that for the wafer to be polished, determining a difference in pressure between a pressure Pc to be applied to the central part of the wafer to be polished by introducing a gas into the central region and a pressure Pe to be applied to the outer peripheral part of the wafer to be polished by introducing a gas into the outer peripheral region based on the in-plane thickness distribution information, determining any one pressure of Pc and Pe, and determining the other pressure based on the determined pressure and the difference in pressure, determining the pressure Pg to be applied from the head main body part downward by pressing the head main body part, based on a set value Pr of a contact pressure to be applied to the lower surface of the second ring-shaped member due to contact with the polishing pad at the time of polishing, and with the determined Pg, Pc, and Pe applied thereto, bringing the lower surface of the wafer to be polished into contact with the polishing pad to conduct polishing.

In one embodiment, the above polishing method can include determining the Pg based on the ratio Pr/Pt of the Pr and a reference value Pt of the contact pressure to be applied to the lower surface of the second ring-shaped member, and the ratio Pe/Pc of the Pe and the Pc.

In one embodiment, the above polishing method can further include determining the Pg by calculating Pg from the mathematical relation of the ratio Pr/Pt, the ratio Pe/Pc, and the Pg.

In one embodiment, the above mathematical relation can be the following equation A. In the equation A, R, X, Y, Z, a, and b are each independently a positive number.

$$Pr/Pt=-R-X(Pe/Pc)+Y(Pg/Pc)+Z((Pe/Pc)-a)((Pg/Pc)-b) \quad \text{(Equation A)}$$

In one embodiment, the above ratio Pr/Pt can fall within the range of 0.8 to 1.2.

A further aspect of the present invention relates to a method of manufacturing a wafer including polishing the surface of a wafer to be polished by the above polishing method to form a polished surface.

In one embodiment, the above wafer can be a semiconductor wafer.

In one embodiment, the above semiconductor wafer can be a silicon wafer.

A further aspect of the present invention relates to, a wafer polishing device including:

a polishing part; and a polishing condition determining part, the polishing part having a polishing head having:

a head main body part, a first ring-shaped member located below the head main body part, and having an opening, a plate-shaped member closing the opening on the upper surface side of the first ring-shaped member, a membrane closing the opening on the lower surface side of the first ring-shaped member, and a second ring-shaped member located below the membrane, and holding a wafer to be polished; and a polishing pad with which the lower surface of the wafer to be polished and the lower surface of the second ring-shaped member come in contact at the time of polishing, a space part formed by closing the opening of the first ring-shaped member by the plate-shaped member and the membrane has a central region and an outer peripheral region partitioned from the central region, the polishing condition determining part, determining a difference in pressure between a pressure Pc to be applied to the central part of the wafer to be polished by introducing a gas into the central region and a pressure Pe to be applied to the outer peripheral part of the wafer to be polished by introducing a gas into the outer peripheral region based on the in-plane thickness distribution information acquire for a wafer to be polished or a wafer subjected to the same processing treatment as that for the wafer to be polished, determining any one pressure of Pc and Pe, and determining the other pressure based on the determined pressure and the difference in pressure, determining the pressure Pg to be applied from the head main body part downward by pressing the head main body part, based on a set value Pr of a contact pressure to be applied to the lower surface of the second ring-shaped member due to contact with the polishing pad at the time of polishing, and with the determined Pg, Pc, and Pe applied thereto, bringing the lower surface of the wafer to be polished into contact with the polishing pad to conduct polishing.

In one embodiment, the above polishing condition determining part can determine the Pg based on the ratio Pr/Pt of the Pr and a reference value Pt of the contact pressure to be applied to the lower surface of the second ring-shaped member, and the ratio Pe/Pc of the Pe and the Pc.

In one embodiment, the above polishing condition determining part can determine the Pg by calculating Pg from the mathematical relation of the ratio Pr/Pt, the ratio Pe/Pc, and the Pg.

In one embodiment, the above mathematical relation can be the equation A previously shown.

In one embodiment, the above ratio Pr/Pt can fall within the range of 0.8 to 1.2.

In one embodiment, the above wafer can be a semiconductor wafer.

In one embodiment, the above semiconductor wafer can be a silicon wafer.

In accordance with one aspect of the present invention, it becomes possible to conduct polishing process of a wafer with high stability.

DESCRIPTION OF EMBODIMENTS

[Wafer Polishing Method]

Figure 1:
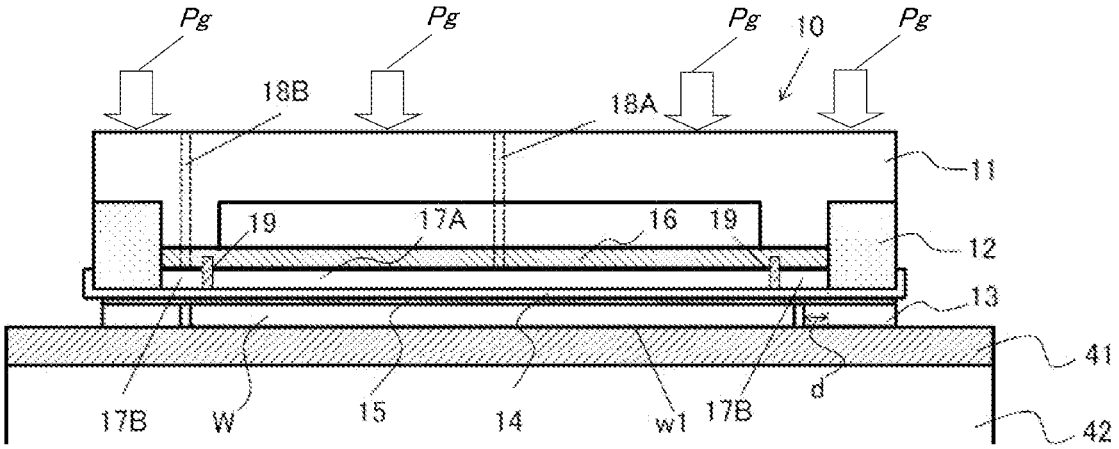
FIG. 1 is a schematic cross sectional view showing one example of a polishing head.

An aspect of the present invention relates to a wafer polishing method of polishing a wafer using a polishing device. The above polishing device includes: a polishing head having a head main body part, a first ring-shaped member located below the head main body part, and having an opening, a plate-shaped member closing the opening on the upper surface side of the first ring-shaped member, a membrane closing the opening on the lower surface side of the first ring-shaped member, and a second ring-shaped member located below the membrane, and holding a wafer to be polished; and a polishing pad with which the lower surface of the wafer to be polished and the lower surface of the second ring-shaped member come in contact at the time of polishing. The space part formed by closing the opening of the first ring-shaped member by the plate-shaped member and the membrane has a central region and an outer peripheral region partitioned from the central region. The above wafer polishing method includes: acquiring in-plane thickness distribution information regarding the wafer to be polished or a wafer subjected to the same processing treatment as that for the wafer to be polished, determining a difference in pressure between a pressure Pc to be applied to the central part of the wafer to be polished by introducing a gas into the central region and a pressure Pe to be applied to the outer peripheral part of the wafer to be polished by introducing a gas into the outer peripheral region based on the in-plane thickness distribution information, determining any one pressure of Pc and Pe, and determining the other pressure based on the determined pressure and the difference in pressure, determining the pressure Pg to be applied from the head main body part downward by pressing the head main body part, based on a set value Pr of a contact pressure to be applied to the lower surface of the second ring-shaped member due to contact with the polishing pad at the time of polishing, and with the determined Pg, Pc, and Pe applied thereto, bringing the lower surface of the wafer to be polished into contact with the polishing pad to conduct polishing.

Below, the above wafer polishing method will be further described in details. In the present invention and in the present specification, the expressions such as "lower surface", "below", "upper surface", and the like mean "lower surface", "below", "upper surface", and the like, respectively, when the polishing head is placed in a state in which a polishing treatment is performed. Below, although one embodiment of the present invention is described by reference to the accompanying drawings, the embodiments shown in the drawings are examples, and the present invention is not limited to such embodiments. Further, in the drawings, the same parts are given the same reference signs and numerals.

<Polishing Device>

The above polishing device includes at least a polishing head and a polishing pad.

(Polishing Head)

The polishing head included in the above polishing device has a head main body part, a first ring-shaped member located below the head main body part, and having an opening, a plate-shaped member closing the opening on the upper surface side of the first ring-shaped member, a membrane closing the opening on the lower surface side of the first ring-shaped member, and a second ring-shaped member located below the membrane, and holding a wafer to be polished. Further, the space part formed by closing the opening of the first ring-shaped member by the plate-shaped member and the membrane has a central region, and an outer peripheral region partitioned from the central region. By using the polishing head thus including the central region and the outer peripheral region provided therein, the polishing surface pressure to be applied to the outer peripheral part of the surface to be polished of the wafer and the polishing surface pressure to be applied to the central part thereof can be each independently controlled.

FIG. 1 is a schematic cross sectional view showing one example of the polishing head included in a polishing device usable in the above polishing method.

In FIG. 1, in a polishing head 10, a head main body part 11 is connected with a first ring-shaped member 12.

The first ring-shaped member 12 is located below the head main body part 11, and has an opening.

The opening on the upper surface side of the first ring-shaped member 12 is closed by a plate-shaped member 16.

The lower surface of the first ring-shaped member 12 is covered with a membrane 14. The membrane 14 closes the opening on the lower surface side of the first ring-shaped member.

Further, the lower surface of the membrane 14 is bonded with a back pad 15.

The membrane 14 has a partition 19. As a result of this, the opening of the first ring-shaped member 12 is closed by the plate-shaped member 16 and the membrane 14, thereby forming a space part having a central region 17A, and an outer peripheral region 17B partitioned from the central region 17A by the partition 19 at the back surface of the membrane 14.

A gas is introduced from a gas introduction path 18A to the central region 17A, and a gas is introduced from a gas introduction path 18B capable of controlling the gas introduction amount independently of the gas introduction path 18A to the outer peripheral region 17B. As a result, the membrane 14 can be inflated to press a wafer W via the back pad 15.

Figure 2:
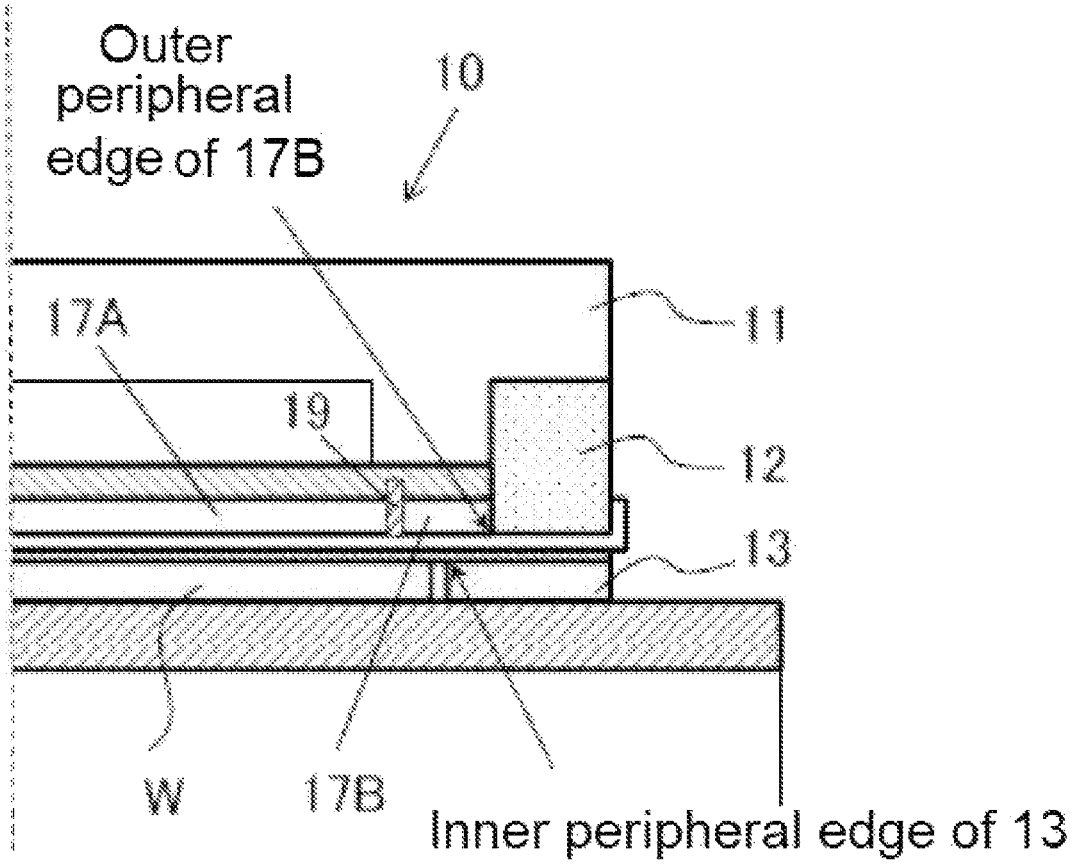
FIG. 2 is a partially enlarged view of the polishing head shown in FIG. 1.

FIG. 2 is a partially enlarged view of the polishing head shown in FIG. 1.

Figure 3:
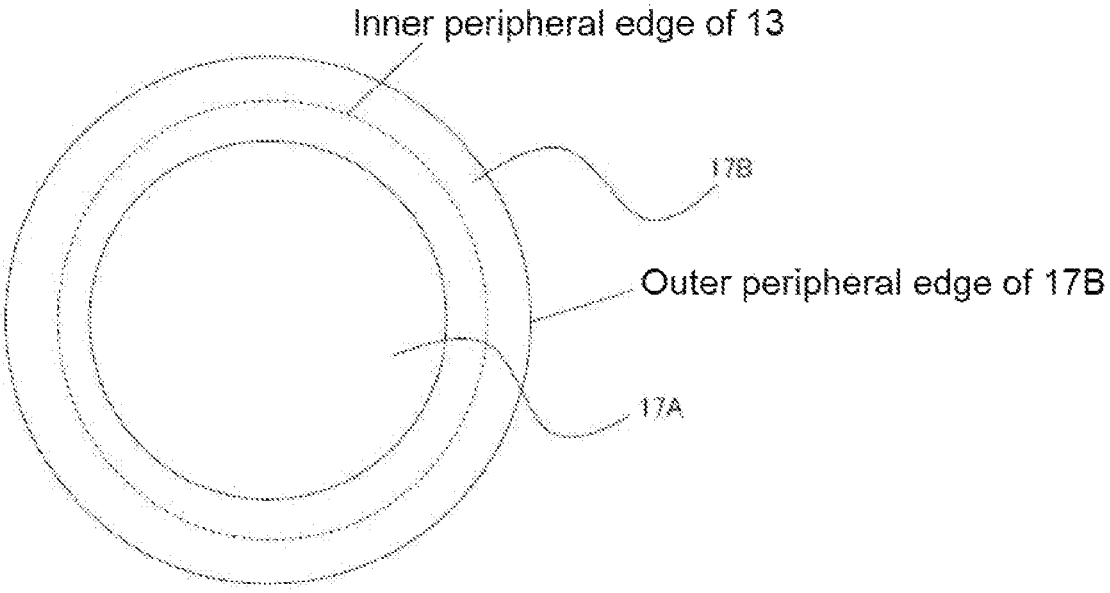
FIG. 3 is a top view showing one example of the positional relationship between the space part and the second ring-shaped member.

A second ring-shaped member 13 holds the wafer W in the opening thereof. Vertically below the outer peripheral end of the outer peripheral region 17B of the space part, the inner peripheral end region of the second ring-shaped member 13 is located. The inner peripheral end region means the inner peripheral edge and the peripheral portion thereof. Namely, when the direction toward the opening of the second ring-shaped member 13 is referred to as the inside, and the other is referred to as the outside, the inner peripheral edge of the second ring-shaped member 13 is located on the inside of the outer peripheral edge of the outer peripheral region 17B of the space part. Further, the partition 19 is located on the inside of the inner peripheral edge of the second ring-shaped member 13. FIG. 3 is a top view showing one example of the positional relationship between the space part and the second ring-shaped member 13.

Further, the polishing head 10 has the outer peripheral region 17B which is an independent space partitioned from the central region 17A by the partition. For example, by changing the amount of the gas to be introduced from the gas introduction path 18A to the central region 17A and the amount of the gas to be introduced from the gas introduction path 18B to the outer peripheral region 17B, it is possible to control the polishing surface pressure to be applied to the outer peripheral part of a surface to be polished w1 of the wafer W under the outer peripheral region 17B independently of the polishing surface pressure to be applied to the central part of the surface to be polished w1 of the wafer W under the central region 17A.

The above polishing head has the configuration described up to this point, and thereby can control the polishing surface pressure to be applied to the outer peripheral part of the surface to be polished of the wafer with ease.

Then, respective parts forming the polishing head will be further described.

As the first ring-shaped member 12, an annular ring made of a rigid material such as a stainless steel material (SUS) commonly used for the polishing head of a one side polishing device can be used.

As the head main body part 11 at which the first ring-shaped member 12 is mounted, a member (for example, a head main body part made of SUS) commonly used for the polishing head of a one side polishing device can be used. The first ring-shaped member 12 can be mounted at the head main body part 11 by a known method such as bolting.

The opening on the lower surface side of the first ring-shaped member 12 is covered and closed with the membrane 14. From the viewpoint of preventing the occurrence of misregistration when the membrane is inflated, the annular lower surface of the first ring-shaped member is preferably also covered with the membrane. Further, the annular lower surface of the first ring-shaped member being also covered with the membrane is also preferable from the viewpoint of suppressing mixing of an abrasive in the opening of the first ring-shaped member. The membrane 14 can be bonded with the annular lower surface of the first ring-shaped member 12 by a known method such as use of an adhesive. In addition, the membrane 14 is also preferably bonded in such a manner as to extend over the side surface of the first ring-shaped member as with the aspects shown in FIGS. 1 and 2. In this manner, the opening on the lower surface side of the first ring-shaped member 12 is closed. Further, the opening on the upper surface side of the first ring-shaped member 12 is closed by the plate-shaped member 16. In this manner, the opening of the first ring-shaped member 12 is closed, resulting in the formation of the space part. In one embodiment, the height of the space part (i.e., the distance between the lower surface of the plate-shaped member 16 and the upper surface of the membrane 14) is preferably about 3.5 to 5.5 mm as the value in a state in which a gas is not introduced into the space part in order to inflate the membrane from the viewpoint of enabling precise control of the in plane distribution of the polishing surface pressure to be applied to the surface to be polished of the wafer W. The height of the space part can be adjusted by, for example, the size of a partition described later.

As the membrane 14, a film made of a material having elasticity such as rubber can be used. Examples of the rubber can include fluorine rubber. The thickness of the membrane 14 has no particular restriction, and can be, for example, about 0.5 to 2 mm.

The plate-shaped member 16 can be, for example, a disk-shaped sheet, and can be mounted at the head main body part 11 by a known method such as bolting. The plate-shaped member 16 is provided with a through hole forming a part of the gas introduction path 18A for introducing a gas to the central region of the space part, and a through hole forming a part of the gas introduction path 18B for introducing a gas to the outer peripheral region of the space part. FIG. 1 shows an embodiment in which one gas introduction path for introducing a gas to the central region of the space part and one gas introduction path for introducing a gas to the outer peripheral region thereof are provided. However, two or more thereof can also be provided at any positions. The number and the positions of respective gas introduction paths are not limited to the embodiment shown in the drawing.

Figure 4A:
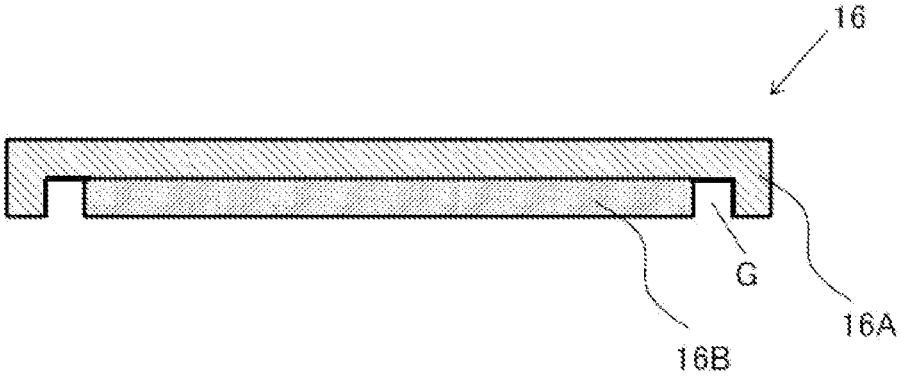
FIG. 4A is a schematic cross sectional view showing one example of a plate-shaped member.
Figure 4B:
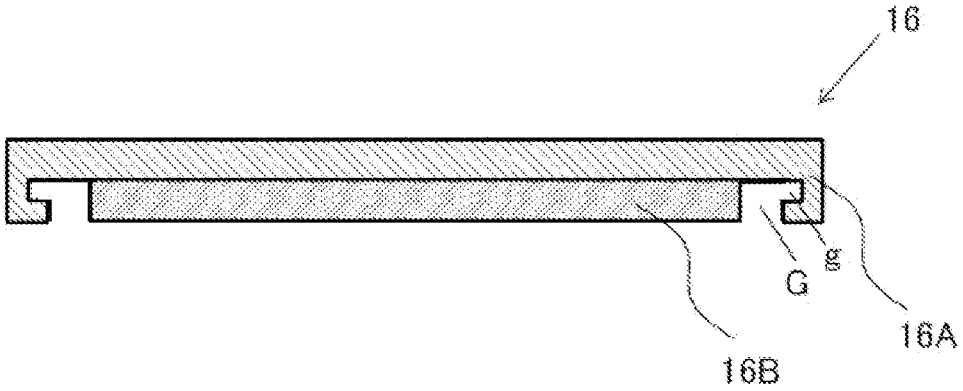
FIG. 4B is a schematic cross sectional view showing one example of the plate-shaped member.

The membrane 14 has the partition 19. The space part formed by closing the opening of the first ring-shaped member 12 with the plate-shaped member 16 and the membrane 14 is divided into the central region 17A and the outer peripheral region 17B by the partition 19. As one example, for example, by inserting a ring-shaped member (partition 19) into the annular groove provided in the plate-shaped member 16, it is possible to mount the partition 19 at the plate-shaped member 16. As one example of the plate-shaped member 16, mention may be made of the one including the first plate-shaped member 16A having a concave part and the second plate-shaped member 16B arranged in the concave part, and having an annular groove Gas shown in FIGS. 4A and 4B. The second plate-shaped member 16B can be mounted at the first plate-shaped member 16A by a known method such as bolting. In the annular groove G, for example, a depression g for inserting a partition having a cross sectional shape of a L shape, or the like described later can be provided at any position according to the shape of the partition.

Figure 5A:
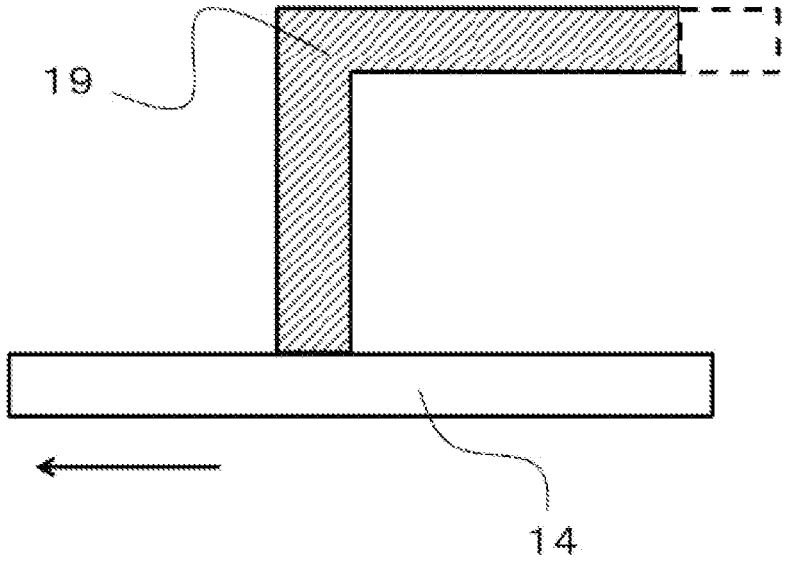
FIG. 5A shows a cross sectional shape example of the partition separating the central region and the outer peripheral region of the space part of the polishing head.
Figure 5B:
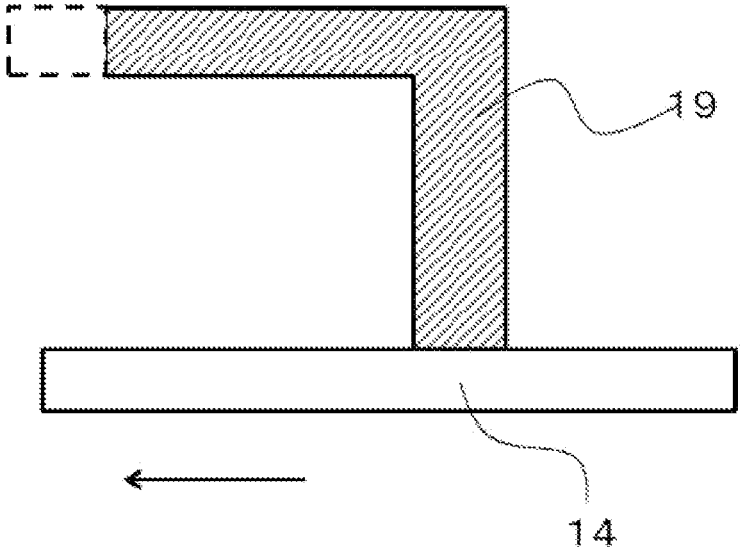
FIG. 5B shows a cross sectional shape example of the partition separating the central region and the outer peripheral region of the space part of the polishing head.
Figure 5C:
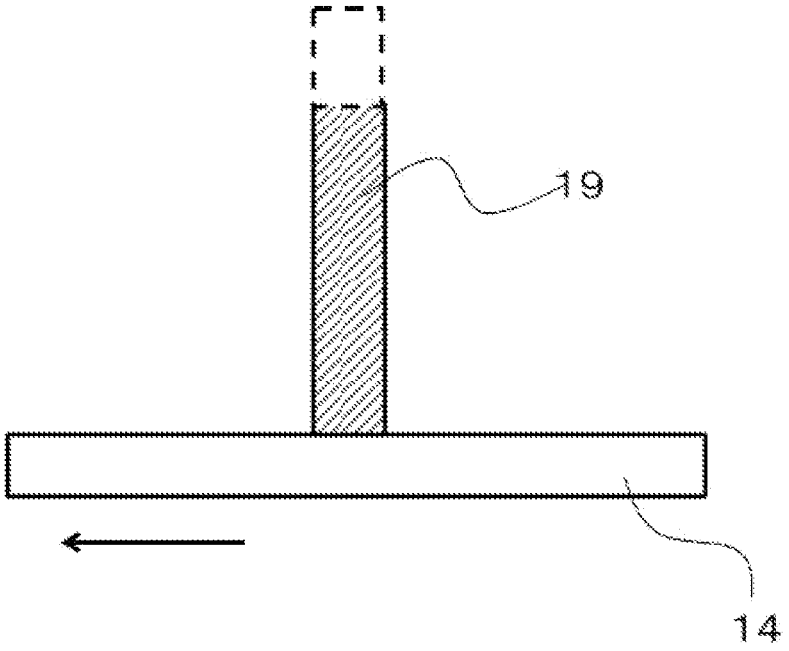
FIG. 5C shows a cross sectional shape example of the partition separating the central region and the outer peripheral region of the space part of the polishing head.
Figure 5D:
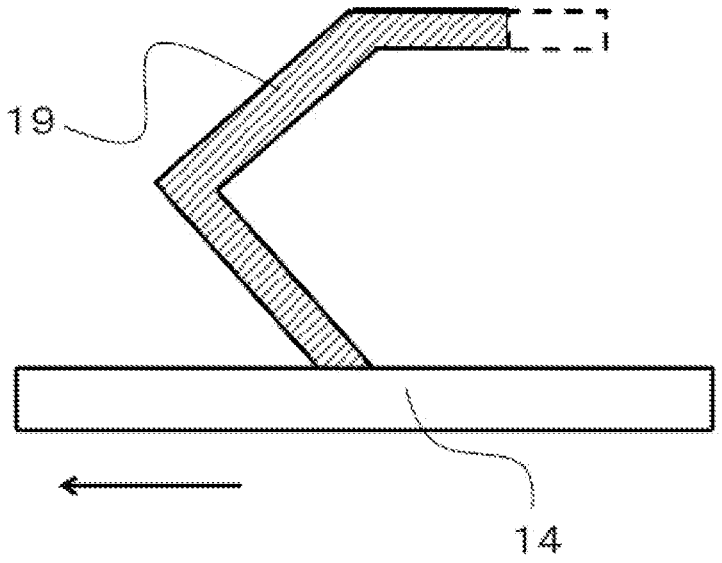
FIG. 5D shows a cross sectional shape example of the partition separating the central region and the outer peripheral region of the space part of the polishing head.
Figure 5E:
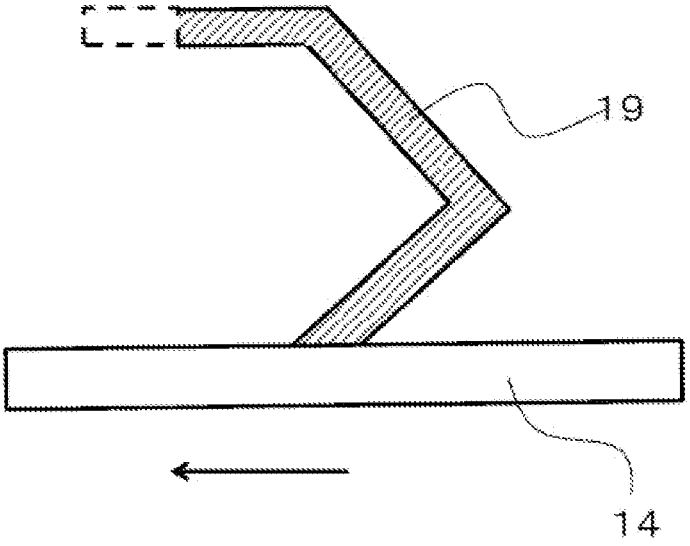
FIG. 5E shows a cross sectional shape example of the partition separating the central region and the outer peripheral region of the space part of the polishing head.
Figure 5F:
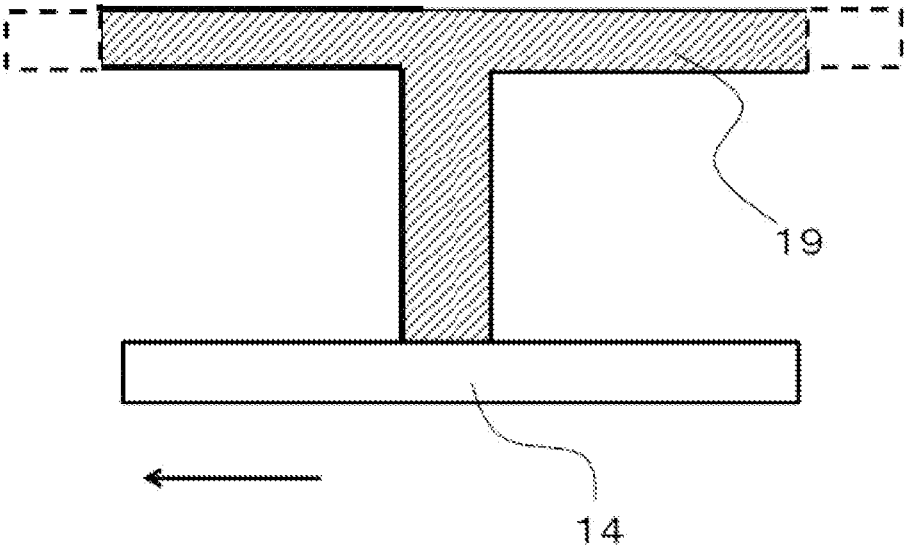
FIG. 5F shows a cross sectional shape example of the partition separating the central region and the outer peripheral region of the space part of the polishing head.

FIGS. 5A to 5F each show a cross sectional shape example of the partition 19. In the drawing, a dotted line part shows the connection part with the plate-shaped member 16, and an arrow shows the central direction of the first ring-shaped member 12. The partition 19 can have, in one embodiment, as shown in FIGS. 5A and 5B, a L-shaped cross sectional shape. In another embodiment, the partition 19 can have, as shown in FIG. 5C, an I-shaped cross sectional shape. Further, in a still other embodiment, the partition 19 can have, as shown in FIGS. 5D and 5E, a cross sectional shape including a V-shaped part. In a furthermore embodiment, the partition 19 can have, as shown in FIG. 5F, a T-shaped cross sectional shape. The partition 19 can be manufactured by forming, for example, a resin or a metal into a desirable shape. The partition 19 preferably has a thickness capable of showing the strength capable of keeping the shape when a gas is introduced into and a pressure is applied to the space part. The thickness can be set at, for example, about 0.5 to 1.5 mm.

Although the method in which the partition 19 and the membrane 14 are manufactured as separate members, and both the members are fixed by an adhesive, or the like can be adopted, the partition 19 is preferably formed integrally with the membrane 14. This is due to the following reason. When a gap is formed between the partition 19 and the membrane 14, ventilation may be caused between the central region 17A and the outer peripheral region 17B separated by the partition 19. In contrast, when the partition 19 and the membrane 14 are integrally formed one member, without causing such ventilation, the partition 19 can separate the central region 17A and the outer peripheral region 17B. Further, it is not easy to bond the partition 19 and the membrane 14 manufactured as separate members uniformly in the peripheral direction. When the bonded state is ununiform, the uniformity of the pressure to be applied to the wafer may be reduced. Alternatively, when a bump is caused in the membrane by the adhesive, the polishing surface pressure may be different between the bump portion and other portions. From the viewpoints described above, the partition 19 is preferably formed integrally with the membrane 14. As the partition 19, the one in a relatively simple shape as with those having a L-shaped cross sectional shape as shown in FIGS. 5A and 5B, and the one having an I-shaped cross sectional shape as shown in FIG. 5C is easy to form irrespective of whether the partition 19 is formed integrally with the membrane 14, or not.

Figure 6:
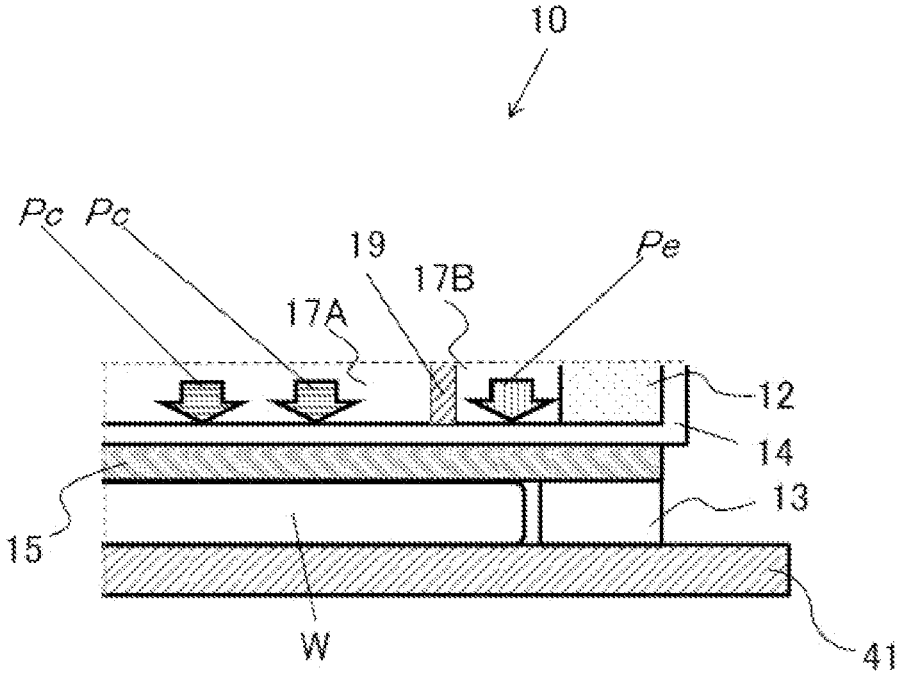
FIG. 6 is an explanatory view regarding the pressure to be applied from the space part of the polishing head to the membrane.

FIG. 6 is an explanatory view regarding the pressure to be applied from the space part to the membrane. In the above polishing head, the space part formed by closing the opening of the first ring-shaped member is partitioned into the central region 17A and the outer peripheral region 17B. The magnitudes of the pressure Pc and the pressure Pe can be each independently controlled by the gas introduction amount to respective regions of the space part, where Pc represents the pressure to be applied to the central part of the wafer W located below the central part of the membrane 14 at the time of polishing by introducing a gas to the central region 17A, and inflating the central part of the membrane 14, and Pe represents the pressure to be applied to the outer peripheral part of the wafer W located below the outer peripheral part of the membrane 14 by introducing a gas to the outer peripheral region 17B, and inflating the outer peripheral part of the membrane 14. Pc and Pe will be further described later.

The lower surface of the membrane 14 is bonded with the back pad 15. The back pad 15 can be bonded with the lower surface of the membrane 14 by a known method such as use of an adhesive. The outer peripheral part of the lower surface of the membrane 14 and the annular upper surface of the second ring-shaped member 13 can come in direct contact with each other. From the viewpoint of suppressing the occurrence of peeling and undulation of the back pad 15, preferably, the back pad 15 is sandwiched between the outer peripheral part of the lower surface of the membrane 14 and the annular upper surface of the second ring-shaped member, and the back pad 15 is interposed between the outer peripheral part of the lower surface of the membrane 14 and the annular upper surface of the second ring-shaped member 13. As the back pad 15, for example, a disk-shaped plate made of a material exhibiting adhesiveness by the surface tension of water when the material contains water such as foamed polyurethane can be used. As a result of this, the wafer W can be held on the back pad 15 containing water.

The second ring-shaped member 13 is the member for holding the wafer W at the opening thereof, and is also referred to as a retainer, a retainer ring, or the like. The second ring-shaped member 13 can be, for example, a ring-shaped member made of glass epoxy. The second ring-shaped member 13 can be bonded with the back pad 15 by a known method such as use of an adhesive. In the above polishing head, vertically below the outer peripheral edge of the outer peripheral region of the space part formed by closing the opening of the first ring-shaped member 12, the inner peripheral edge region of the second ring-shaped member (particularly, the inner peripheral side region of the annular upper surface of the second ring-shaped member) is situated. As a result of this, without locating the outer peripheral part of the surface to be polished w1 of the wafer W vertically below the outer peripheral edge of the space part, the surface to be polished w1 of the wafer W can be polished. For example, by arranging the second ring-shaped member having a smaller inner diameter than the inner diameter of the first ring-shaped member concentrically with the first ring-shaped member, it is possible to arrange the inner peripheral edge region of the second ring-shaped member vertically below the outer peripheral edge of the space part formed by closing the opening of the first ring-shaped member. From the viewpoint of readily performing control of the polishing surface pressure to be applied to the outer peripheral part of the surface to be polished of the wafer, the region with a width ("d" in FIG. 1) of about 8 to 25 mm from the inner peripheral edge toward the outer peripheral side at the annular upper surface of the second ring-shaped member is preferably located below the outer peripheral region 17B of the space part. The thickness of the second ring-shaped member 13 may be determined according to the thickness of the wafer to be polished W. Further, the diameter of the opening of the second ring-shaped member 13 may also be determined according to the diameter of the wafer to be polished W. The second ring-shaped member 13 can be a ring-shaped member made of a material commonly used for the retainer ring of the polishing head.

The second ring-shaped member 13 comes in contact at its lower surface with the polishing pad 41 at the time of polishing. The second ring-shaped member is applied with the pressure (pressure Pg described in details later: see FIG. 1) to be applied from the head main body part downward by pressing the head main body part 11 by a pressure control mechanism (not shown) at the time of polishing, and the pressure due to the self-weight of the main body part 11 and the self-weight of the first ring-shaped member 12. When the contact pressure to be applied to the lower surface of the second ring-shaped member 13 due to contact with the polishing pad 41 at the time of polishing is excessive, the abrasion or the deterioration of the second ring-shaped member 13 may be caused. On the other hand, when the contact pressure is too small, falling off of the wafer W may be caused at the time of polishing. The occurrence of such a phenomenon reduces the stability of polishing processing. However, with the above polishing method, by determining Pg as described in details later, it is possible to set the proper polishing conditions with ease. As a result, it becomes possible to reduce the abrasion and the deterioration of the second ring-shaped member 13, and/or to prevent falling off of the wafer.

Examples of the wafers W to be polished can include various semiconductor wafers such as a silicon wafer. The semiconductor wafer is a wafer having a disk shape, as is well known.

(Configuration Example of Polishing Device)

Figure 7:
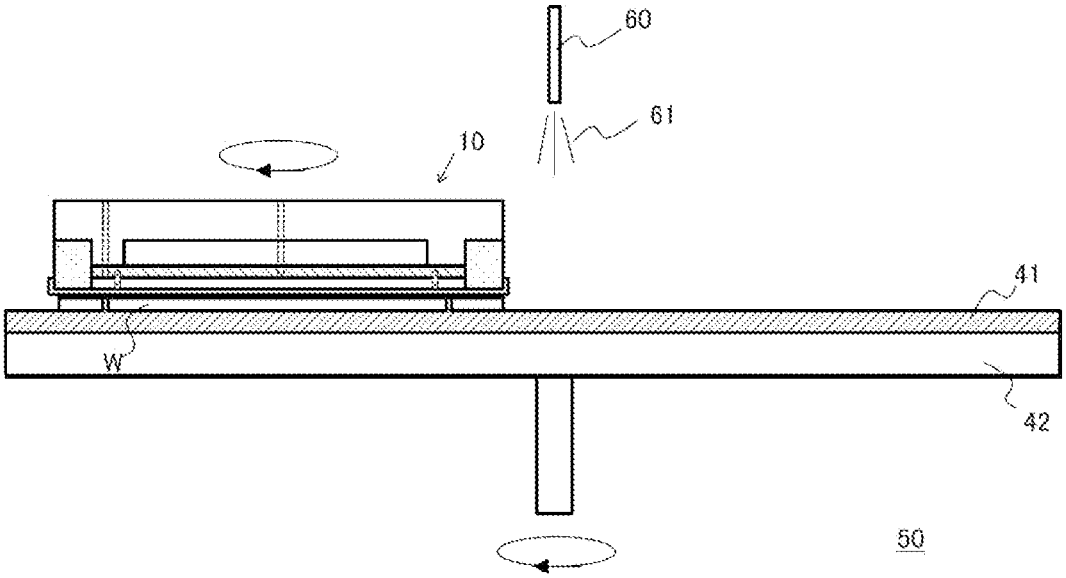
FIG. 7 is a schematic cross sectional view showing one example of a polishing device.

The polishing device usable in the above polishing method includes the polishing head and the polishing pad, and can further include a surface plate supporting the polishing pad. FIG. 7 is a schematic cross sectional view showing one example of such a polishing device. While respectively rotating the polishing head 10 and the surface plate 42 by a rotary mechanism (not shown), the surface to be polished of the wafer W and the polishing pad 41 bonded onto the surface plate 42 are brought into contact with each other. An abrasive 61 discharged from an abrasive supply mechanism 60 is supplied to between the surface to be polished of the wafer W and the polishing pad 41. Thus, the surface to be polished of the wafer W is polished. As the abrasive, a polishing slurry commonly used for CMP (Chemical Mechanical Polishing) can be used. To the details of the thickness, the material, and the like of the polishing pad 41, the known techniques regarding polishing processing of a wafer are applicable. As the polishing pad 41, for example, a commercially available product can be used. The polishing device used in the above polishing method can have the same configuration as that of a common one side polishing device except for inclusion of the polishing pad and the polishing head previously described.

<Determination of Polishing Conditions>

In order to improve the stability of polishing processing in polishing of a wafer, the contact pressure to be applied to the lower surface of the second ring-shaped member by contact with the polishing pad at the time of polishing is desirably set at a proper value. This is due to the following: as previously described, by properly controlling the polishing pressure, it is possible to reduce the abrasion and the deterioration of the second ring-shaped member, and/or to prevent falling off of a wafer at the time of polishing. Further, the contact pressure being a proper value, specifically, the above contact pressure being kept at a given value, or the change in the above contact pressure being reduced during polishing can also suppress fluctuations in polishing amount of the wafer outer peripheral part. This point can also contribute to the improvement of the stability of polishing processing in wafer polishing. For example, by performing polishing processing with Pg, Pc, and Pe kept constant at respective set values during polishing, it is possible to keep the contact pressure to be applied to the lower surface of the second ring-shaped member by contact with the polishing pad at the time of polishing at a given value, or to reduce the change therein. As a result of this, it is possible to suppress the fluctuations in polishing amount of the wafer outer peripheral part.

Below, a description will be given to the method for determining the polishing conditions in the above polishing method appropriately referring to the flowchart shown in FIG. 8. However, the embodiments described below are examples, and the above polishing method is not limited only to the exemplified embodiments.

(Acquisition of Wafer In-Plane Thickness Distribution Information)

In the above polishing method, as previously described, the space part formed by closing the opening of the first ring-shaped member by the plate-shaped member and the membrane has a central region and an outer peripheral region partitioned from the central region.

By thus performing partition into the central region and the outer peripheral region, the pressure Pc and the pressure Pe can be each independently controlled. When Pc and Pe can be each independently controlled, the in-plane polishing amount can be changed according to the in-plane thickness distribution of the surface to be polished of the wafer. This is preferable for, for example, enabling provision of a wafer excellent in in-plane uniformity of the wafer thickness. In order to set such Pc and Pe, in the polishing method, for the wafer to be polished, or a wafer subjected to the same processing treatment as that for the wafer to be polished, the in-plane thickness distribution information is acquired (S1 in FIG. 8). The in-plane thickness distribution information can be, for example, information regarding the difference in thickness between the wafer central part and the wafer outer peripheral part. The central part regarding the wafer denotes a partial region including the wafer center, and the outer peripheral part denotes the region surrounding the central part. This point also applies to the central part and the outer peripheral part regarding the membrane. The measurement of the thickness of the wafer can be performed by a known thickness measuring means of a contact type or a non-contact type. Herein, the thickness of the central part can be the value of the thickness at one site of the central part. Alternatively, the thickness of the central part can be the arithmetic average of the thicknesses of two or more sites of the central part, or the like. This point also applies to the thickness of the outer peripheral part. The in-plane thickness distribution information can be, in one embodiment, acquired by performing the thickness measurement using the wafer to be polished itself. In another embodiment, the in-plane thickness distribution information can be acquired by performing the thickness measurement using the wafer subjected to the same processing treatment as that for the wafer to be polished. Herein, the term "wafer subjected to the same processing treatment" denotes the wafer for which the steps up to before performing polishing in the polishing method have been performed under the same conditions. However, for "the same conditions", a common potential difference in the wafer manufacturing steps is allowable. For example, when a plurality of wafers subjected to the same processing treatment are polished, the in-plane thickness distribution information is acquired for some wafers of the plurality of wafers, and the acquired in-plane thickness distribution information can be used for determining the polishing conditions of the plurality of wafers. The number of the some wafers can be one, or two or more. In the case of two or more wafers, as the in-plane thickness distribution information, the in-plane thickness distribution information obtained from the arithmetic average of the measurement values obtained for the two or more wafers, or the like can be used.

(Determination of Difference in Pressure Between Pc and Pe, Determination of Pc and Pe)

Figure 8:
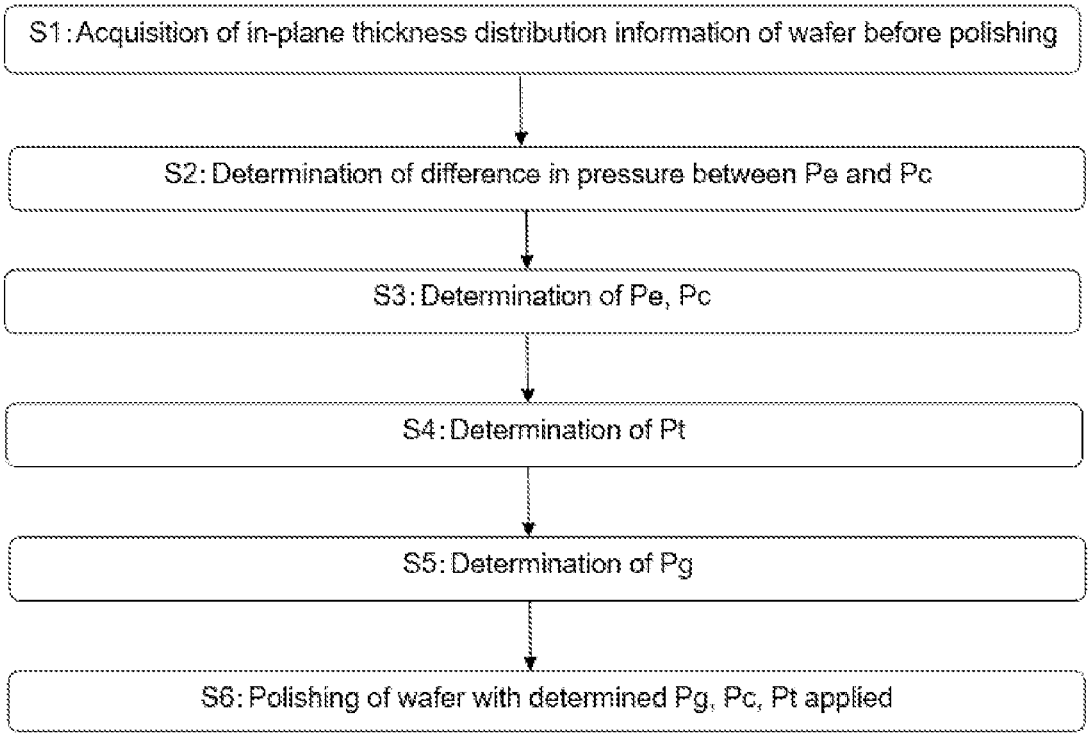
FIG. 8 is a flowchart showing one example of a polishing method.

After acquiring the above in-plane thickness distribution information, based on the acquired in-plane thickness distribution information, the difference in pressure between the pressure Pc to be applied to the central part of the wafer to be polished by introducing a gas to the central region of the space part formed by closing the opening of the first ring-shaped member, and the pressure Pe to be applied to the outer peripheral part of the wafer to be polished by introducing a gas to the outer peripheral region of the space part is determined (S2 in FIG. 8). Such a difference in pressure can be specifically the difference in pressure (Pe−Pc) or the difference in pressure (Pc−Pe), and is preferably the difference in pressure (Pe−Pc).

Figure 9:
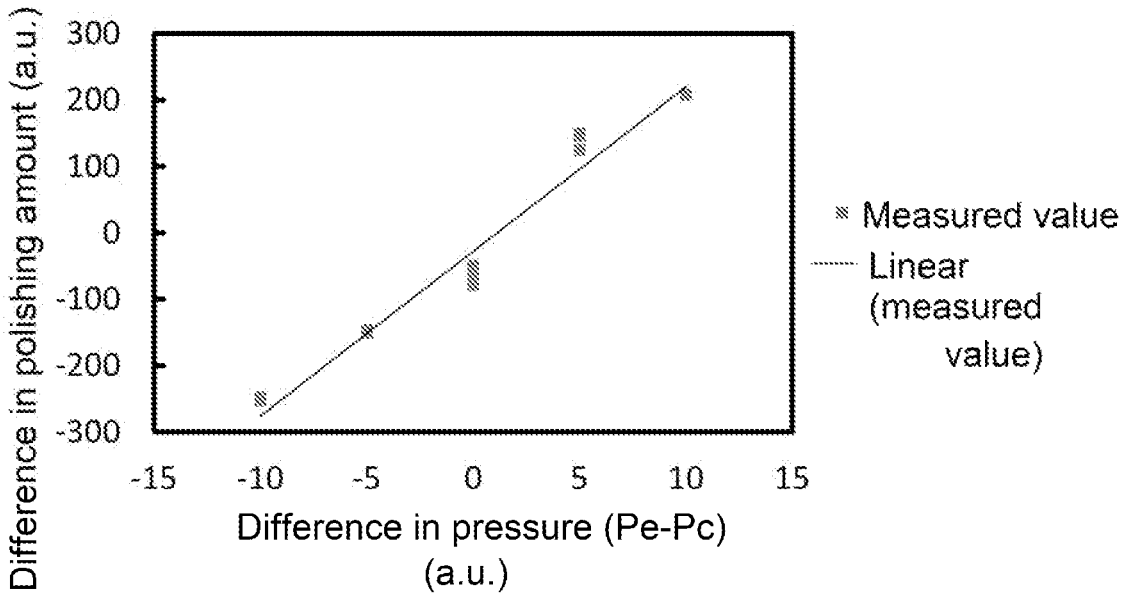
FIG. 9 is one example of the graph showing the correlation between the difference in polishing amount between the polishing amount of the wafer outer peripheral part and the polishing amount of the wafer central part in polishing processing and the difference in pressure (Pe−Pc).

In accordance with the study by the present inventors, the polishing amount of the wafer outer peripheral part can be made larger than the polishing amount of the wafer central part with an increase in difference in pressure (Pe−Pc). Regarding this point, FIG. 9 is one example of the graph showing the correlation between the difference in polishing amount between the polishing amount of the wafer outer peripheral part and the polishing amount of the wafer central part in polishing processing and the difference in pressure (Pe−Pc). Herein, the polishing amount is the thickness of the portion to be removed by polishing processing, and can be calculated as the difference in wafer thickness between before and after polishing (wafer thickness before polishing−wafer thickness after polishing). In the drawing, "a.u." denotes an arbitrary unit. The difference in polishing amount between the polishing amount of the wafer outer peripheral part and the polishing amount of the wafer central part in polishing processing is taken on the vertical axis, and the difference in pressure (Pe−Pc) is taken on the horizontal axis, thereby forming a graph. The measured values are subjected to linear approximation with the least square method. This results in an approximate straight line of $y=cx+d$ (c and d are each independently a positive number). The square of the correlation coefficient of the approximate straight line $R^2=0.96$, which indicates a high correlation.

As described above, the difference in pressure between Pe and Pc can control the difference in polishing amount between the wafer outer peripheral part and the wafer central part. On the other hand, in the previously acquired in-plane thickness distribution information of the wafer, when the thickness of the wafer outer peripheral part is larger than the thickness of the wafer central part, the polishing amount of the outer peripheral part is preferably set larger than that of the central part with an increase in the difference in thickness in order to improve the in-plane uniformity of the wafer thickness after polishing. For example, the difference in polishing amount desirable for improving the in-plane uniformity of the wafer thickness after polishing is determined based on the difference between the thickness of the wafer outer peripheral part and the thickness of the wafer central part. Based on the determined difference in polishing amount, using the correlation as shown in FIG. 9 (for example, the approximate straight line), the difference in pressure (Pe−Pc) can be determined.

Figure 10:
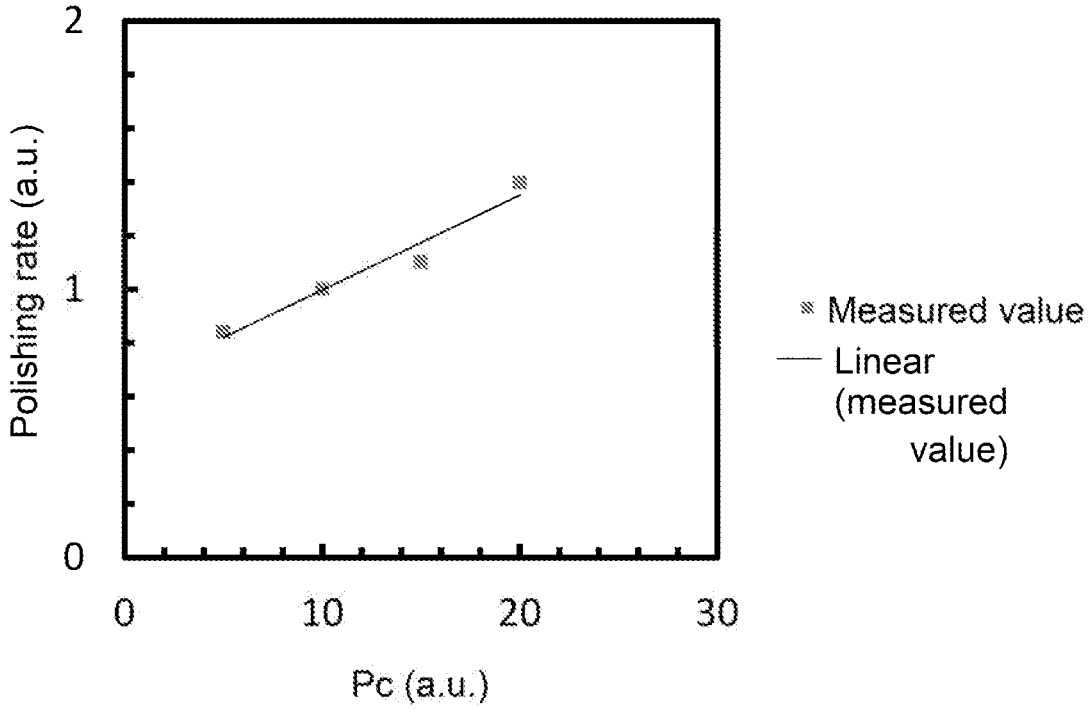
FIG. 10 is one example of the graph showing the correlation between the polishing rate of the wafer central part and Pc.

When the difference in pressure can be determined as described above, by determining any one pressure of Pe and Pc to be applied at the time of polishing, the other pressure can also be determined based on the difference in pressure (S3 in FIG. 8). By determining the polishing time tin consideration of the throughput, and the polishing amount target value B in consideration of the ideal value of the wafer thickness according to the intended use, the polishing rate A can be calculated from the mathematical relation: $A \times t = B$. The polishing rate is the polishing amount per unit time. In accordance with the study by the present inventors, the polishing amount per unit time can be increased (i.e., the polishing rate can be increased) with an increase in pressure Pc. Regarding this point, FIG. 10 is one example of the graph showing the correlation between the polishing rate of the wafer central part and Pc. The polishing rate is taken on the vertical axis, and Pc is taken on the horizontal axis, thereby forming a graph. Thus, the measured value is subjected to linear approximation with the least square method, resulting in an approximate straight line of y=ex+f (e and f are each independently a positive number). The square of the correlation coefficient of the approximate straight line $R^2$=0.95, which indicates a high correlation. For example, Pc can be calculated and determined from the value of the polishing rate A determined by the mathematical relation using the correlation as shown in FIG. 10 (for example, the approximate straight line). When Pc is thus determined, the Pe can be calculated and determined from the value of the difference in pressure determined as described above and the determined Pc.

(Determination of Pg)

As described previously, by determining the difference in pressure between Pc and Pe based on the in-plane thickness distribution information of the wafer, it becomes possible to set Pc and Pe at proper values, and to perform polishing. This is, as described above, for example, preferable for improving the in-plane uniformity of the wafer thickness after polishing. On the other hand, as described previously, for improving the stability of polishing processing, the contact pressure to be applied to the lower surface of the second ring-shaped member due to contact with the polishing pad at the time of polishing is desired to be a proper value. The contact pressure is affected by the pressure Pg to be applied downward from the head main body part by pressing the head main body part. Therefore, the polishing conditions are preferably determined so as to enable Pg to be set at a proper value. Regarding this point, in the above polishing method, based on the set value Pr of the contact pressure to be applied to the lower surface of the second ring-shaped member, the pressure Pg to be applied downward from the head main body part by pressing the head main body part is determined. By thus determining Pg, Pg can be set at a proper value. As a result, it becomes possible to set the contact pressure to be applied to the lower surface of the second ring-shaped member due to contact with the polishing pad at the time of polishing at a proper value.

The Pr can be said to be the value equal to, or the value close to the contact pressure to be actually applied to the lower surface of the second ring-shaped member due to contact with the polishing pad at the time of polishing. In one embodiment, Pr can be determined based on experiences, or Pr can be determined by performing a preparatory experiment. In this case, Pr can be determined based on experiences, or can be determined by performing a preparatory experiment at the value which is less likely to cause inconvenience for polishing as the contact pressure to be applied to the lower surface of the second ring-shaped member due to contact with the polishing pad at the time of polishing. Examples of the inconvenience for polishing may include falling off of a wafer at the time of polishing, and breakage of the constituent member of the polishing device.

Further, in one embodiment, for determining Pr, the reference value Pt of the contact pressure to be applied to the lower surface of the second ring-shaped member can be first determined (S4 in FIG. 8). Pt can be said to be the value serving as the criterion or the standard with respect to Pr. As for the specific embodiment of Pt determination, the previous description on Pr determination can be referenced. The ratio Pr/Pt of Pr and Pt can fall within, for example, the range of 0.8 to 1.2.

Determination of Pg (S5 in FIG. 8) can be performed based on Pr. In addition, the contact pressure to be applied to the lower surface of the second ring-shaped member due to contact with the polishing pad at the time of polishing is affected by the pressure Pg to be applied downward from the head main body part by pressing the head main body part, and can also be further affected by the pressure Pc to be applied to the central part of the wafer to be polished, and the pressure Pe to be applied to the outer peripheral part of the wafer to be polished. Therefore, the determination of Pg based on Pr is also preferably performed in consideration of Pc and Pe. For example, the determination of Pg based on Pr can be performed based on the ratio Pr/Pt, and the ratio Pe/Pc of Pe and Pc. Specific examples of the determination method may include the method for calculating Pg from the mathematical relation of the ratio Pr/Pt, the ratio Pe/Pc, and Pg. Examples of the mathematical relation may include the following equation A. In the equation A, coefficients R, X, Y, Z, a, and b are each independently a positive number. The coefficient in the equation A can be experimentally determined in one embodiment. Further, in one embodiment, for example, Pr is determined from the pressure calculation with Pc, Pe, and Pg changed, and, Pr/Pt, Pe/Pc, and Pg/Pc are calculated. Then, the coefficient in the equation A can be determined from the multivariate regression analysis of Pr/Pt, Pe/Pc, and Pg/Pc. The pressure calculation can be performed by, for example, simulation such as FEM (Finite Element Method) according to the configuration of the polishing head.

$$Pr/Pt=-R-X(Pe/Pc)+Y(Pg/Pc)+Z((Pe/Pc)-a)((Pg/Pc)-b) \quad \text{(Equation A)}$$

In one embodiment, the equation A can be the following equation A-1.

$$Pr/Pt=-0.3282-0.2087(Pe/Pc)+0.7947(Pg/Pc)+0.0293((Pe/Pc)-0.9)((Pg/Pc)-2.1) \quad \text{Equation A-1}$$

Pg, Pc, and Pe can be determined in the above manner.

As described above, in the above polishing method, the proper polishing conditions can be determined with ease without repeating much trial and error.

<Carrying Out Polishing>

In the above polishing method, with the determined Pg, Pc, and Pe applied thereto, the lower surface of the wafer to be polished is brought into contact with the polishing pad, thereby performing polishing (S6 in FIG. 8). Known techniques regarding wafer polishing are applicable except for performing polishing with the determined Pg, Pc, and Pe applied thereto. The wafer to be polished can be, for example, a semiconductor wafer. The semiconductor wafer can be, for example, a silicon wafer (preferably, a single crystal silicon wafer). For example, a silicon wafer can be manufactured in the following manner. A single crystal ingot is pulled up with the Czochralski method, and the manufactured ingot is cut, resulting in a block. The resulting block is sliced, resulting in a wafer. The wafer is subjected to various processings. As a result, a silicon wafer can be manufactured. Examples of the processing include chamfering processing, flattening processing (lapping, grinding, and polishing), and the like. The above polishing method is preferable as the polishing method in a finishing polishing step of the final step of the wafer processings.

[Method of Manufacturing Wafer]

One aspect of the present invention relates to a method of manufacturing a wafer (which will be also referred to merely as a "manufacturing method") including polishing the surface of the wafer to be polished by the above polishing method, thereby forming a polished surface.

The wafer polishing in the above manufacturing method is as described previously regarding the above polishing method. For various steps to be performed for the wafer to be manufactured and wafer manufacturing, the previous description regarding the above polishing method can be referenced, and known techniques are also applicable thereto.

[Wafer Polishing Device]

Another aspect of the present invention relates to a wafer polishing device (which will also be hereinafter referred to merely as a "polishing device").

The above polishing device includes a polishing part, and a polishing condition determining part.

The above polishing part has, a polishing head having:

a head main body part, a first ring-shaped member located below the head main body part, and having an opening, a plate-shaped member closing the opening on the upper surface side of the first ring-shaped member, a membrane closing the opening on the lower surface side of the first ring-shaped member, a second ring-shaped member located below the membrane, and holding a wafer to be polished; and a polishing pad with which the lower surface of the wafer to be polished and the lower surface of the second ring-shaped member come in contact at the time of polishing.

The space part formed by closing the opening of the first ring-shaped member by the plate-shaped member and the membrane has a central region and an outer peripheral region partitioned from the central region.

As for the above polishing part, the previous description regarding the polishing device usable in the above polishing method can be referenced. The above polishing part brings the lower surface of the wafer to be polished into contact with the polishing pad with Pg, Pc, and Pe determined at the polishing condition determining part applied thereto, and thereby performs polishing. The wafer polishing and the wafer to be polished are as described previously regarding the above polishing method.

The polishing condition determining part included in the above polishing device, determines the difference in pressure between the pressure Pc to be applied to the central part of the wafer to be polished by introducing a gas into the central region, and the pressure Pe to be applied to the outer peripheral part of the wafer to be polished by introducing a gas into the outer peripheral region based on the in-plane thickness distribution information acquired for the wafer to be polished or the wafer subjected to the same processing treatment as that for the wafer to be polished, determines any one pressure of Pc and Pe, and determines the other pressure based on the determined pressure and the difference in pressure, and determines the pressure Pg to be applied from the head main body part downward by pressing the head main body part, based on a set value Pr of a contact pressure to be applied to the lower surface of the second ring-shaped member due to contact with the polishing pad at the time of polishing.

The above polishing condition determining part can determine Pg based on the ratio Pr/Pt of Pr and the reference value Pt of the contact pressure to be applied to the lower surface of the second ring-shaped member, and the ratio Pe/Pc of Pe and Pc. The determination of Pg can be performed by calculating Pg from the mathematical relation of the ratio Pr/Pt, the ratio Pe/Pc, and Pg. Examples of the mathematical relation include the previously shown equation A. The equation A can be the previously shown equation A-1.

Various determinations executed by the above polishing condition determining part are as described previously regarding the above polishing method.

Figure 11:
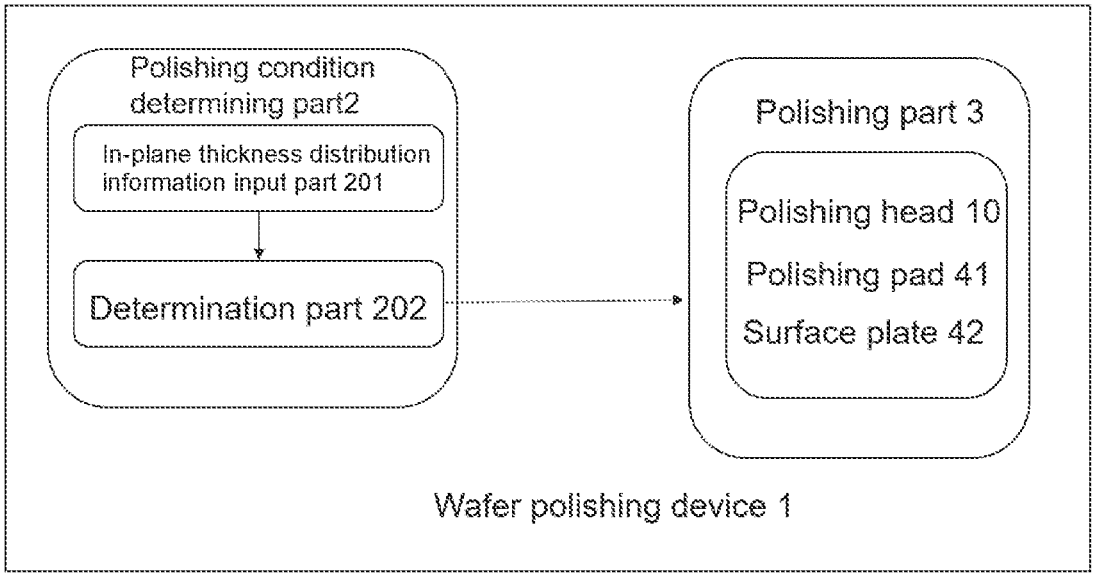
FIG. 11 is a schematic view showing a configuration of one example of a wafer polishing device.

FIG. 11 is a schematic view showing the configuration of one example of the above polishing device. In FIG. 11, the wafer polishing device 1 includes a polishing condition determining part 2 and a polishing part 3. As for the polishing head 10, the polishing pad 41, and the surface plate 42 included in the polishing part 3, the previous description can be referenced.

The polishing condition determining part 2 has an in-plane thickness distribution information input part 201 and a determination part 202. To the in-plane thickness distribution information input part 201, the in-plane thickness distribution information acquired for the wafer to be polished or the wafer subjected to the same processing treatment as that for the wafer to be polished is inputted. The wafer polishing device 1 can include a wafer thickness measurement part (not shown). Introduction of the wafer to be measured to the wafer thickness measurement part can be performed manually or automatically. For example, the polishing step can be automated so that the wafer to be polished before being introduced to the polishing part 3 is introduced to the wafer thickness measurement part. The determination part 202 receives or retrieves the in-plane thickness distribution information from the in-plane thickness distribution information input part 201, and determines Pg, Pc, and Pe as described previously. The determination can be performed using known calculation software. With the calculation software, for example, calculation of difference in pressure (Pe−Pc) by the previously described correlation (for example, approximate curve), determination of Pc based on the mathematical relation, calculation of Pe from Pc and the difference in pressure (Pe−Pc), calculation of Pt or Pr by structural analysis of stress/displacement by FEM or the equilibrium equation of force, and calculation of Pg by the equation A are performed.

The polishing part 1 can receive or take, in one embodiment, the values of Pg, Pc, and Pe from the determination part 10. The polishing part 1 can determine the pressing conditions of the head main body part, and the introducing conditions of a gas to the central region and the outer peripheral region of the space part so as to apply Pg, Pc, and Pe, and can perform polishing. In addition, in one embodiment, the pressing conditions and/or the gas introducing conditions can also be determined using, for example, known calculation software at the determination part 10, and the information regarding the determined conditions can be transmitted to the polishing part 1, or can be taken from the determination part 10.

With the wafer polishing device, the polishing condition determining part and the polishing part can be connected with each other by a wireless or wired communication means. This point also applies to the wafer thickness measurement part and the polishing condition determining part. FIG. 11 shows an example in which the wafer polishing device includes one polishing part for one polishing condition determining part. However, the above wafer polishing device is not limited to such an example. For example, one polishing condition determining part and two or more polishing parts can also be connected by wireless or wired communication means.

EXAMPLES

Below, the present invention will be described based on Examples. However, the present invention is not limited to embodiments shown in Examples. Below, the polishing surface pressure and the contact pressure were determined with pressure calculation (finite element method) using ABAQUS manufactured by DASSALT SYSTEMS Co.

In the structural analysis model of the polishing head with the configuration shown in FIG. 1, by simulation with FEM, Pr was determined from the pressure calculation with Pc, Pe, and Pg changed, thereby calculating Pr/Pt, Pe/Pc, and Pg/Pc, and various coefficients in the equation A were determined from the multivariate regression analysis of Pr/Pt, Pe/Pc, and Pg/Pc. Specifically, Pr/Pt is taken on the vertical axis, and Pg/Pc is taken on the horizontal axis. A graph showing the relationship between Pr/Pt and Pg/Pc for the case of Pe/Pc=0.2, 0.4, 0.6, 0.8, 1.0, 1.2, 1.4, or 1.6 is formed. As the mathematical relation holding among Pr/Pt, Pe/Pc, and Pg/Pc determined by subjecting all 80 data of the graph to multivariate regression analysis, the previously shown equation A-1 was determined (the square of the correlation coefficient of the approximate straight line $R^2$=0.99).

Table 1 is the table of the summary of the relationship between the polishing conditions and the stable polishing feasibility based on findings obtained by pressure calculation (finite element method) using ABAQUS manufactured by DASSALT SYSTEMS Co, and experimentally. In the table, "WF falling off" denotes the occurrence of falling off of a wafer at the time of polishing, and "excessive abrasion" denotes the occurrence of excessive abrasion of the second ring-shaped member. "Good" denotes that polishing is possible with stability without causing these. For example, when Pg is set at, for example, the value leading to Pg/Pc=1.2 or Pg/Pc=3.0 as a result of determining Pg at a constant value without being based on Pr, falling off of a wafer at the time of polishing and excessive abrasion of the second ring-shaped member are caused, resulting in the reduction of the stability of polishing processing. Further, as shown in Table 1, when Pg/Pc=2.2, although a value of Pe/Pc falling within the range of 1.0 to 1.6 results in "Good", a value within the range of 0.2 to 0.8 causes excessive abrasion of the second ring-shaped member, resulting in the reduction of the stability of polishing processing. That is, when Pg is set at a value leading to, for example, Pg/Pc=2.2 as a result of determining Pg at a constant value without being based on Pr, excessive abrasion of the second ring-shaped member may be caused.

In contrast, with the above polishing method, for example, Pc and Pe are determined as described previously, and Pg is determined by using the equation A-1 within a range such that Pr/Pt is 0.8 to 1.2, and the polishing conditions (Pc, Pe, and Pg at the time of polishing) are set. As a result, it is possible to suppress falling off of a wafer at the time of polishing and excessive abrasion of the second ring-shaped member, and to perform polishing processing of a wafer with high stability. Further, determination of such polishing conditions can be performed with ease, for example, in line with the flow as described previously, without going through much trial and error.

Further, by performing the polishing processing with Pg, Pc, and Pe kept constant at the respective set values during polishing, the contact pressure to be applied to the lower surface of the second ring-shaped member due to contact with the polishing pad at the time of polishing can be kept at a constant value, or the changes can be reduced. As a result of this, it is possible to suppress fluctuations in polishing amount of the wafer outer peripheral part.

TABLE 1

| | | Pe/Pc | | | | | | | |
|---|---|---|---|---|---|---|---|---|---|
| | | 0.2 | 0.4 | 0.6 | 0.8 | 1.0 | 1.2 | 1.4 | 1.6 |
| Pg/Pc | 1.2 | Pr/Pt = 0.6 (WF falling off) | Pr/Pt = 0.6 (WF falling off) | Pr/Pt = 0.6 (WF falling off) | Pr/Pt = 0.5 (WF falling off) | Pr/Pt = 05 (WF falling off) | Pr/Pt = 0.4 (WF falling off) | Pr/Pt = 0.4 (WF falling off) | Pr/Pt = 0.3 (WF falling off) |
| | 2.0 | Pr/Pt = 1.2 (Good) | Pr/Pt = 1.2 (Good) | Pr/Pt = 1.2 (Good) | Pr/Pt = 1.1 (Good) | Pr/Pt = 1.1 (Good) | Pr/Pt = 1.0 (Good) | Pr/Pt = 1.0 (Good) | Pr/Pt = 1.0 (Good) |
| | 2.2 | Pr/Pt = 1.4 (Excessive abrasion) | Pr/Pt = 1.4 (Excessive abrasion) | Pr/Pt = 1.3 (Excessive abrasion) | Pr/Pt = 1.3 (Excessive abrasion) | Pr/Pt = 12 (Good) | Pr/Pt = 1.2 (Good) | Pr/Pt = 1.1 (Good) | Pr/Pt = 1.1 (Good) |
| | 3.0 | Pr/Pt = 2 (Excessive abrasion) | Pr/Pt = 2 (Excessive abrasion) | Pr/Pt = 1.9 (Excessive abrasion) | Pr/Pt = 1.9 (Excessive abrasion) | Pr/Pt = 1.8 (Excessive abrasion) | Pr/Pt = 1.8 (Excessive abrasion) | Pr/Pt = 1.8 (Excessive abrasion) | Pr/Pt = 1.7 (Excessive abrasion) |

Figure 12:
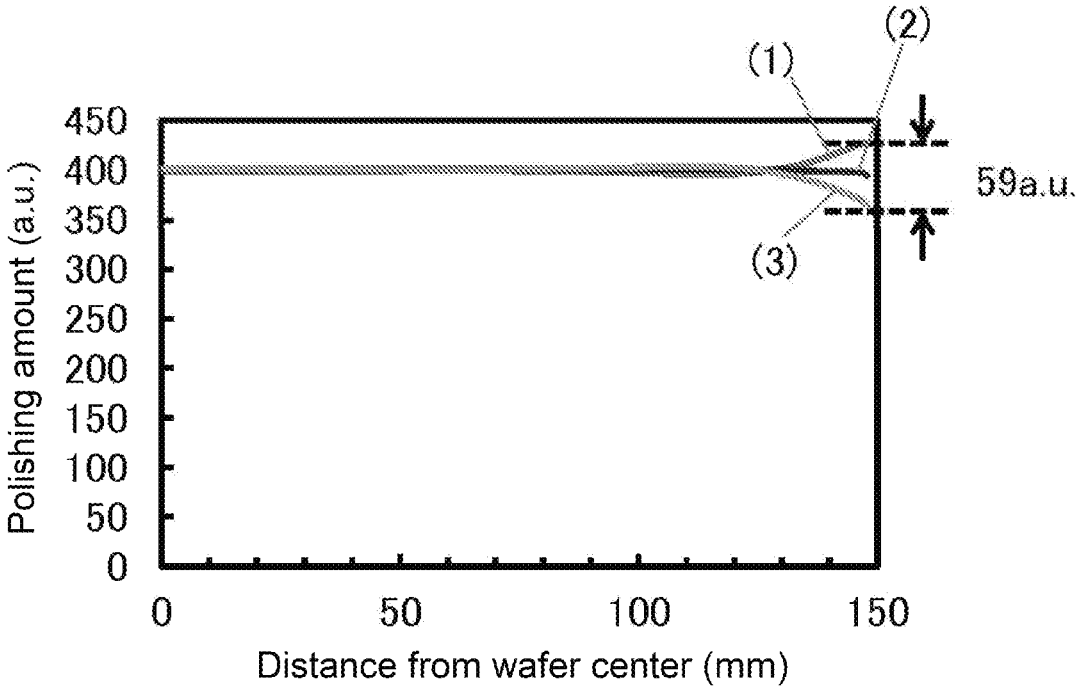
FIG. 12 is a graph showing the in-plane polishing amount distribution of the surface to be polished of a wafer when the polishing conditions are different.

FIG. 12 is a graph showing the in-plane polishing amount distribution of the surface to be polished of a wafer when the polishing conditions are different. The polishing amounts of respective in-plane parts shown in FIG. 12 were calculated by the Preston formula for the cases where Pe/Pc is 1, and Pr (particularly, Pr/Pt) and Pg (particularly, Pg/Pc) are different as with the following equations (1) to (3):

$$Pr/Pt=0.5,\ Pg/Pc=1.2 \tag{1}$$

$$Pr/Pt=1.0,\ Pg/Pc=1.9 \tag{2}$$

$$Pr/Pt=1.8,\ Pg/Pc=3.0. \tag{3}$$

As described previously, the difference in polishing amount between the wafer outer peripheral part and the wafer central part can be controlled by the difference in pressure between Pe and Pc. In addition, the results shown in FIG. 12 indicate as follows: when, Pe and Pc are not changed, a variation in Pg changes Pr; as a result, the polishing amount of the wafer outer peripheral part is changed. Particularly, the polishing amount of the wafer outer peripheral part is increased with an increase in Pg, and is decreased with a decrease in Pg. For example, for the in-plane uniformity of the wafer thickness after polishing, as described previously, when the thickness of the outer peripheral part of the wafer to be polished is larger than the thickness of the central part, the polishing amount of the outer peripheral part is preferably made larger than that of the central part with an increase in difference in thickness therebetween in order to improve the in-plane uniformity of the wafer thickness after polishing. In other words, when the difference between the thickness of the outer peripheral part of the wafer to be polished and the thickness of the central part is small, the difference between the polishing amount of the central part and the polishing amount of the outer peripheral part is preferably small in order to improve the in-plane uniformity of the wafer thickness after polishing. Thus, when wafers having different shapes are polished, the polishing conditions are preferably set properly, respectively, according to the shape of the wafer to be polished. As for this point, by the above polishing method, based on the in-plane thickness distribution information acquired for the wafer to be polished or the wafer subjected to the same processing treatment as that for the wafer to be polished, Pg, Pc, and Pe can be determined at proper values capable of implementing the respective polishing amounts desired according to respective shapes of the wafers. Furthermore, the determination can be performed with ease without going through much trial and error.

One aspect of the present invention is useful in the technical field of a semiconductor wafer such as a silicon wafer.

The invention claimed is:

1. A wafer polishing method of polishing a wafer with a polishing device, wherein the polishing device comprises:

a polishing head comprising:

a head main body part, a first ring-shaped member located below the head main body part, and having an opening, a plate-shaped member closing the opening on an upper surface side of the first ring-shaped member, a membrane closing the opening on a lower surface side of the first ring-shaped member, and a second ring-shaped member located below the membrane, and holding a wafer to be polished; and a polishing pad with which a lower surface of the wafer to be polished and a lower surface of the second ring-shaped member come in contact at the time of polishing, a space part formed by closing the opening of the first ring-shaped member by the plate-shaped member and the membrane has a central region and an outer peripheral region partitioned from the central region, the wafer polishing method comprises:

acquiring in-plane thickness distribution information regarding the wafer to be polished or a wafer subjected to the same processing treatment as that for the wafer to be polished, determining a difference in pressure between a pressure Pc to be applied to a central part of the wafer to be polished by introducing a gas into the central region and a pressure Pe to be applied to an outer peripheral part of the wafer to be polished by introducing a gas into the outer peripheral region based on the in-plane thickness distribution information, determining any one pressure of Pc and Pe, and determining the other pressure based on the determined pressure and the difference in pressure, determining a pressure Pg to be applied from the head main body part downward by pressing the head main body part, based on a set value Pr of a contact pressure to be applied to the lower surface of the second ring-shaped member due to contact with the polishing pad at the time of polishing, and with the determined Pg, Pc, and Pe applied thereto, bringing the lower surface of the wafer to be polished into contact with the polishing pad to conduct polishing.

2. The wafer polishing method according to claim 1, which comprises determining the Pg based on a ratio Pr/Pt of the Pr and a reference value Pt of the contact pressure to be applied to the lower surface of the second ring-shaped member, and a ratio Pe/Pc of the Pe and the Pc.

3. The wafer polishing method according to claim 2, which further comprises determining the Pg by calculating Pg from a mathematical relation of the ratio Pr/Pt, the ratio Pe/Pc, and the Pg.

4. The wafer polishing method according to claim 3, wherein the mathematical relation is the following equation A:

$$Pr/Pt=-R-X(Pe/Pc)+Y(Pg/Pc)+Z((Pe/Pc)-a)((Pg/Pc)-b) \quad \text{(Equation A)}$$

in the equation A, R, X, Y, Z, a, and b are each independently a positive number.

5. The wafer polishing method according to claim 2, wherein the ratio Pr/Pt falls within a range of 0.8 to 1.2.

6. A method of manufacturing a wafer, comprising polishing a surface of a wafer to be polished by the polishing method according to claim 1 to form a polished surface.

7. The method of manufacturing a wafer according to claim 6, wherein the wafer is a semiconductor wafer.

8. The method of manufacturing a wafer according to claim 7, wherein the semiconductor wafer is a silicon wafer.

9. A wafer polishing device, which comprises:

a polishing part; and a processor, the polishing part comprising a polishing head having:

a head main body part, a first ring-shaped member located below the head main body part, and having an opening, a plate-shaped member closing the opening on an upper surface side of the first ring-shaped member, a membrane closing the opening on a lower surface side of the first ring-shaped member, and a second ring-shaped member located below the membrane, and holding a wafer to be polished; and a polishing pad with which a lower surface of the wafer to be polished and a lower surface of the second ring-shaped member come in contact at the time of polishing, a space part formed by closing the opening of the first ring-shaped member by the plate-shaped member and the membrane has a central region and an outer peripheral region partitioned from the central region, the processor, determining a difference in pressure between a pressure Pc to be applied to a central part of the wafer to be polished by introducing a gas into the central region and a pressure Pe to be applied to an outer peripheral part of the wafer to be polished by introducing a gas into the outer peripheral region based on in-plane thickness distribution information acquire for a wafer to be polished or a wafer subjected to the same processing treatment as that for the wafer to be polished, determining any one pressure of Pc and Pe, and determining the other pressure based on the determined pressure and the difference in pressure, determining a pressure Pg to be applied from the head main body part downward by pressing the head main body part, based on a set value Pr of a contact pressure to be applied to the lower surface of the second ring-shaped member due to contact with the polishing pad at the time of polishing, and with the determined Pg, Pc, and Pe applied thereto, bringing the lower surface of the wafer to be polished into contact with the polishing pad to conduct polishing.

10. The wafer polishing device according to claim 9, wherein the processor determines the Pg based on a ratio Pr/Pt of the Pr and a reference value Pt of the contact pressure to be applied to the lower surface of the second ring-shaped member, and a ratio Pe/Pc of the Pe and the Pc.

11. The wafer polishing device according to claim 10, wherein the processor determines the Pg by calculating Pg from a mathematical relation of the ratio Pr/Pt, the ratio Pe/Pc, and the Pg.

12. The wafer polishing device according to claim 11, wherein the mathematical relation is the following equation A:

$$Pr/Pt=-R-X(Pe/Pc)+Y(Pg/Pc)+Z((Pe/Pc)-a)((Pg/Pc)-b) \quad \text{(Equation A)}$$

in the equation A, R, X, Y, Z, a, and b are each independently a positive number.

13. The wafer polishing device according to claim 10, wherein the ratio Pr/Pt falls within a range of 0.8 to 1.2.

14. The wafer polishing device according to claim 9, wherein the wafer is a semiconductor wafer.

15. The wafer polishing device according to claim 14, wherein the semiconductor wafer is a silicon wafer.

* * * * *